US008689911B2

(12) United States Patent
Stowe, II et al.

(10) Patent No.: US 8,689,911 B2
(45) Date of Patent: Apr. 8, 2014

(54) CUTTER AND CUTTING TOOL INCORPORATING THE SAME

(75) Inventors: Calvin J. Stowe, II, Ballaire, TX (US); Andrew Ponder, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 281 days.

(21) Appl. No.: 12/537,710

(22) Filed: Aug. 7, 2009

(65) Prior Publication Data

US 2011/0031035 A1 Feb. 10, 2011

(51) Int. Cl.
*E21B 10/573* (2006.01)

(52) U.S. Cl.
USPC ..... 175/432; 175/435

(58) Field of Classification Search
USPC ..... 175/435, 432, 430
See application file for complete search history.

(56) References Cited

U.S. PATENT DOCUMENTS 4,109,737 A * 8/1978 Bovenkerk ..... 175/430
4,796,709 A 1/1989 Lynde et al.
4,862,977 A * 9/1989 Barr et al. ..... 175/432
4,978,260 A 12/1990 Lynde et al.
5,011,515 A * 4/1991 Frushour ..... 51/307
5,058,666 A 10/1991 Lynde et al.
5,150,755 A 9/1992 Cassel et al.
5,297,630 A 3/1994 Lynde et al.
5,351,772 A * 10/1994 Smith ..... 175/428
5,373,900 A 12/1994 Lynde et al.
5,435,403 A * 7/1995 Tibbitts ..... 175/432
5,456,312 A 10/1995 Lynde et al.
5,486,137 A * 1/1996 Flood et al. ..... 451/540
5,709,279 A * 1/1998 Dennis ..... 175/430
5,711,702 A * 1/1998 Devlin ..... 451/540
5,810,079 A 9/1998 Lynde et al.
5,848,657 A * 12/1998 Flood et al. ..... 175/426
5,899,268 A 5/1999 Lynde et al.
5,906,246 A * 5/1999 Mensa-Wilmot et al. .... 175/432
5,971,087 A * 10/1999 Chaves ..... 175/432
6,041,875 A * 3/2000 Rai et al. ..... 175/432
6,082,474 A * 7/2000 Matthias ..... 175/432
6,098,729 A * 8/2000 Matthias ..... 175/420.1
6,148,937 A * 11/2000 Mensa-Wilmot et al. .... 175/428
6,189,634 B1 * 2/2001 Bertagnolli et al. ..... 175/432
6,202,771 B1 * 3/2001 Scott et al. ..... 175/432
6,216,805 B1 * 4/2001 Lays et al. ..... 175/374
6,408,959 B2 * 6/2002 Bertagnolli et al. ..... 175/432

(Continued)

OTHER PUBLICATIONS

Ronald D. Childers and Gregory C C. Miller, "PCD Technology Advances Sidetracking Capabilities"; SPE 59185; Feb. 23, 2000; pp. 1-9; XP-002354486.

*Primary Examiner* — Shane Bomar
*Assistant Examiner* — Wei Wang
(74) *Attorney, Agent, or Firm* — Cantor Colburn LLP

(57) ABSTRACT

A cutter for a downhole cutting tool is disclosed. The cutter includes a cutter body having a cutting face, a peripheral sidewall flank, and a base. The base has a recessed channel that extends inwardly from the peripheral sidewall flank and provides an inlet opening therein. A downhole cutting tool employing the cutter is also disclosed. The cutting tool includes a tool body having a cutter face. The tool also includes a cutter body having a cutting face, a peripheral sidewall flank, and a base, the base having a recessed channel that extends inwardly from the peripheral sidewall flank and provides an inlet opening therein. The tool also includes a braze joint between the base and the bonding surface.

26 Claims, 10 Drawing Sheets

(56) References Cited

U.S. PATENT DOCUMENTS

| | | | | |
|---|---|---|---|---|
| 6,460,637 | B1 * | 10/2002 | Siracki et al. | 175/430 |
| 6,464,434 | B2 | 10/2002 | Lynde | |
| 6,470,558 | B1 | 10/2002 | Russell et al. | |
| 6,488,106 | B1 * | 12/2002 | Dourfaye | 175/428 |
| 6,527,069 | B1 * | 3/2003 | Meiners et al. | 175/432 |
| 6,739,417 | B2 * | 5/2004 | Smith et al. | 175/432 |
| 6,892,836 | B1 * | 5/2005 | Eyre et al. | 175/432 |
| 7,108,064 | B2 | 9/2006 | Hart et al. | |
| 7,178,609 | B2 | 2/2007 | Hart et al. | |
| 7,353,893 | B1 * | 4/2008 | Hall et al. | 175/425 |
| 7,363,992 | B2 * | 4/2008 | Stowe et al. | 175/426 |
| 7,533,739 | B2 * | 5/2009 | Cooley et al. | 175/432 |
| 7,533,740 | B2 * | 5/2009 | Zhang et al. | 175/432 |
| 7,665,552 | B2 * | 2/2010 | Hall et al. | 175/426 |
| 7,762,359 | B1 * | 7/2010 | Miess | 175/432 |
| 7,942,218 | B2 * | 5/2011 | Cooley et al. | 175/432 |
| 8,028,774 | B2 * | 10/2011 | Hall et al. | 175/434 |
| 2005/0109546 | A1 | 5/2005 | Stowe et al. | |
| 2006/0090897 | A1 | 5/2006 | Stowe et al. | |
| 2006/0278441 | A1 * | 12/2006 | Cooley et al. | 175/374 |
| 2007/0181348 | A1 * | 8/2007 | Lancaster et al. | 175/432 |
| 2007/0278017 | A1 * | 12/2007 | Shen et al. | 175/426 |
| 2008/0006446 | A1 * | 1/2008 | Stowe et al. | 175/263 |
| 2008/0202754 | A1 | 8/2008 | Soni et al. | |
| 2008/0236900 | A1 * | 10/2008 | Cooley et al. | 175/432 |
| 2009/0183925 | A1 * | 7/2009 | Zhang et al. | 175/432 |
| 2011/0031035 | A1 * | 2/2011 | Stowe et al. | 175/430 |
| 2011/0031036 | A1 * | 2/2011 | Patel | 175/430 |

* cited by examiner

CUTTER AND CUTTING TOOL INCORPORATING THE SAME

BACKGROUND

The invention relates generally to cutters, downhole cutting tools that employ such cutters, including arms and blades of underreamers, mills and other downhole cutting tools and methods of making the same.

Rotary cutting mills, mandrel cutters and the like are downhole cutting devices or tools that are incorporated into a drill string and used to cut laterally through metallic tubular members, such as casing on the sides of a wellbore, liners, tubing, pipe or mandrels. Mandrel cutters are used to create a separation in metallic tubular members. Cutting mills are tools that are used in a sidetracking operation to cut a window through surrounding casing and allow drilling of a deviated drill hole. On conventional tools of this type, numerous small individual cutters are attached to multiple arms or blades that are rotated about a hub. Most conventional cutters present a circular cutting face. Other conventional cutter shapes include square, star-shaped, and trapezoidal, although these are less common.

Improved cutter designs and improved designs for downhole cutting tools that use them, such as mandrel cutters and rotary cutter mills, having a rectangular, rounded "lozenge" shape have been proposed. This cutter has a cross-sectional cutting area having a pair of curvilinear end sections an elongated central section with a length that is greater than the width. The cutter may also include a raised peripheral cutter edge for breaking chips during cutting. Cutters of this type have an improved geometry over circular cutters, and particularly have reduced interstitial space as compared to circular cutters. While these lozenge shape cutters have reduced interstitial spaces associated with adjacent cutters, they have a relatively higher amount of total surface area that requires bonding to the cutting tools on which they are employed. This bonding is generally accomplished by brazing the lozenge shape base of the cutter to the desired cutting surface of the cutting tool. The relatively higher amount of total surface area of the cutters may increase the potential for defects in the braze joints between the cutters and the cutting tools.

Thus, in addition to realizing the performance benefits of the cutters described, an improved metallurgical bond to their enhanced surface area is desirable.

SUMMARY

In an exemplary embodiment, a cutter for a downhole cutting tool is disclosed. The cutter includes a cutter body having a cutting face, a peripheral sidewall flank and a base, the base having a recessed channel that extends inwardly from the peripheral sidewall flank and provides an inlet opening therein.

In another exemplary embodiment, a downhole cutting tool is disclosed. The downhole cutting tool includes a tool body having a cutting face. The cutting tool also includes a cutter body having a cutting face, a peripheral sidewall flank, and a base, the base having a recessed channel that extends inwardly from the peripheral sidewall flank and provides an inlet opening therein. The cutting tool also includes a braze joint between the base and the bonding surface of the cutting tool.

BRIEF DESCRIPTION OF THE DRAWINGS

Referring now to the drawings wherein like elements are numbered alike in the several Figures.

DETAILED DESCRIPTION

Figures 1, 2, 3:
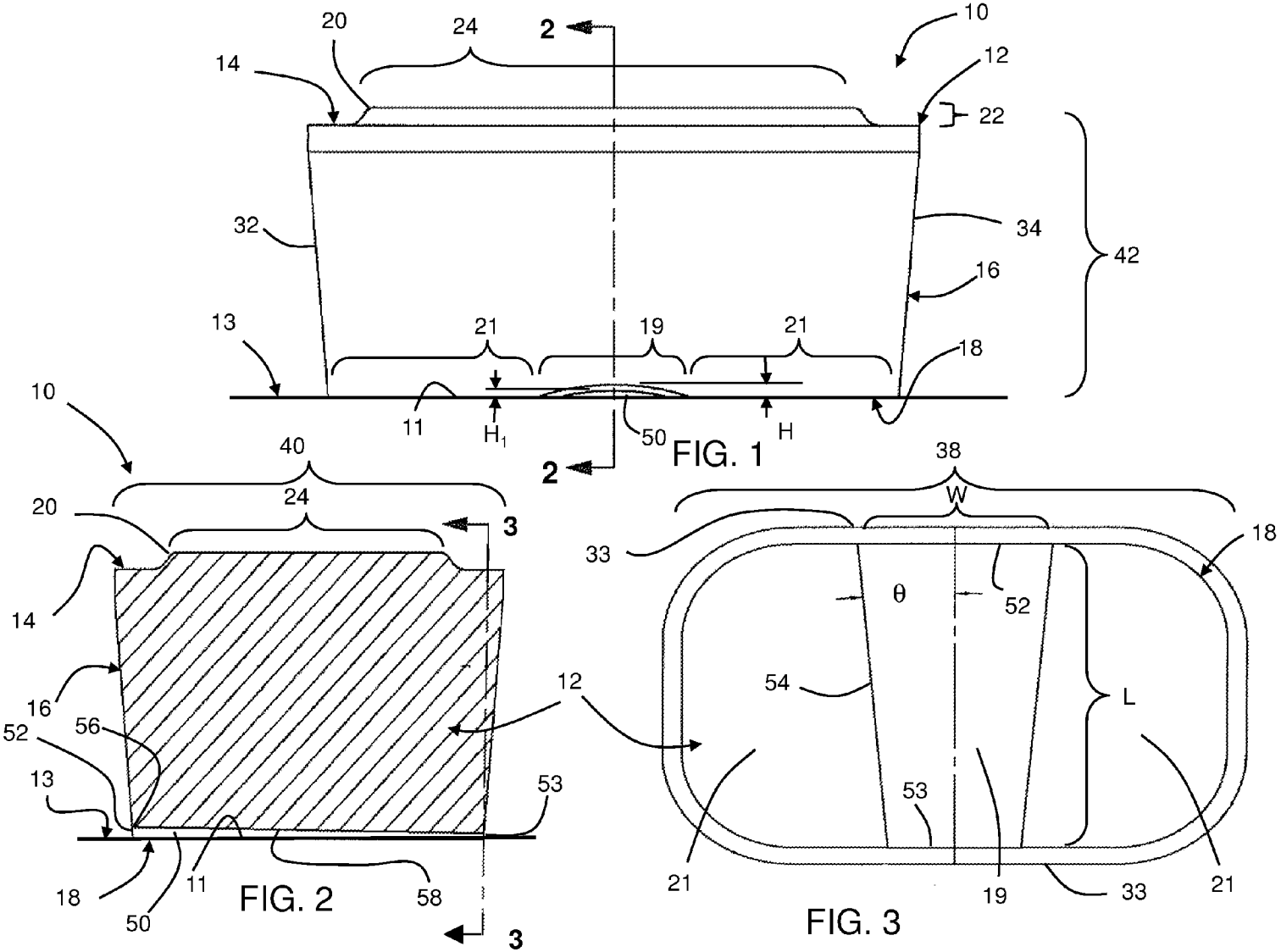
FIG. 1 is a front view of an exemplary embodiment of a cutter as disclosed herein.
FIG. 2 is a cross-sectional view of the cutter of FIG. 1 taken along section 2-2 thereof.
FIG. 3 is a bottom view of the exemplary embodiment of FIG. 1.

Applicants have observed that when using lozenge shaped cutters to form cutting tools by brazing a planar contact surface of the cutter to the cutting tool there exists a potential for the formation of voids in the metallurgical bond between the base of the cutter and the bonding surface of the cutting tool. Without being bound by theory, these voids result from the rapid flow of the braze material around the periphery of the base of the cutter, thereby entrapping air, flux or other contaminants within the metallurgical bond of the braze joint. Once entrapped within the joint, these materials may exert pressure within the pockets in which they are entrapped that resists the further flow of the braze material across the base of the cutter. Upon cooling and solidification of the braze material, these pockets of contaminants result in voids within the braze joint and associated metallurgical bonds between the cutter and the cutting tool that may act as stress risers within the joint during operation of the cutting tool producing increased stresses within the joint, particularly sheer stresses. Increased stresses within the braze joint resulting from these voids can result in separation of the cutter and reduce the useful life of the associated cutting tool.

Applicants have discovered that the employment of cutters having a recessed flow channel formed in the contact surface may be advantageously used to control and direct the flow of the braze material during the formation of the braze joint, thereby reducing the propensity for entrapment of flux, air and other contaminants within the bond with a concomitant reduction in the formation of voids within the braze joint and associated metallurgical bonds, thereby improving the quality and strength of these joints. Improved braze joints between the cutters and the cutting tools provides an associated improvement in the operating lifetime of these tools. Applicants have discovered that the use of a flow channel and control of its characteristics, including its location, length, width and height, may be advantageously used to provide flow and wetting of the molten braze material across the contact surface of the cutter to reduce or eliminate the propensity for entrapment of contaminants and formation of voids. While Applicants have observed that many channel shapes may be employed to improve the flow across the contact surface, in particular, Applicants have discovered that flow channels that are asymmetric with respect to one or more axes of the cutter, such as a longitudinal or lateral axis thereof, are particularly useful to promote the advantageous flow of the braze material described above. Further, Applicants have observed flow is aided by increasing the length of the perimeter of the joint, and inhibited by the decreasing the thickness of the joint. The geometry of the flow channel may be advantageously controlled to promote enhanced capillarity with respect to the perimetral length to promote flow of the braze material across the contact surface during brazing.

The use of flow channels as disclosed herein are distinguished from and an advantageous improvement over cutter designs having a flat base or those having a plurality of spaced cylindrical or conical or convex legs that protrude from the base as spacers to define the thickness of the braze joint. They are distinguished by the inclusion of a recess in the base in contrast to a flat base, or a flat base with a plurality of spaced protruding legs as spacers. These differences result in differences that occur to the flow of the molten braze materials during the brazing process that result in differences in the resulting braze joints and associated metallurgical bonds. The designs in which the base is flat or includes spaced protruding legs are subject to the rapid flow of the braze material around the periphery of the base to effectively seal the periphery, thereby entrapping fluxes, gases and other contaminants within the periphery that result in voids or other defects in the braze joint. For example, the addition of spaced legs does not result in a variation of capillarity during brazing that avoids the problems associated with flat base cutters, i.e., enclosure of the periphery, or that forces flow of the braze materials through a flow channel associated with the recess and across the surface of the base as the cutter, thereby reducing the propensity for entrapment of fluxes, gases and other contaminants within the periphery of the cutter, as occurs during brazing of the cutters disclosed herein.

Thus, Applicants have discovered new and useful cutters having flow channels incorporated into their bond surfaces to produce braze joints having improved quality and strength when joined to the cutting faces of downhole cutting tools. The improved cutters and braze joints produce a concomitant improvement in the strength and longevity of downhole cutting tools that employ them. By promoting improved flow and wetting of the braze material the channels also reduce porosity or void formation within the braze joint and associated metallurgical bonds.

FIGS. 1-13 depict exemplary embodiments of cutters 10 for use with downhole cutting tools as disclosed herein. In the exemplary embodiments, the cutter 10 has a cutter body 12 formed of hardened material having a hardness, strength and other material properties that make it suitable for use as a cutter for a downhole cutting tool. Suitable hardened materials include any material having a hardess sufficient to bore a desired earth formation that is also brazable. By way of example and not limitation, materials that may be used to form hardened materials include tungsten carbide (WC, $W_2C$). The cutter body 12 features include a cutting face 14, a peripheral sidewall flank 16 and a base 18. Cutting face 14 is the free surface of the cutter that is configured to provide cutting action when cutter 10 is employed in a cutting tool. It may be a planar or a curved face, including outwardly convex or inwardly concave cutting face configurations. Preferably, the cutter 10 features a raised chip-breaking edge 20. Chip-breaking edge 20 is located on a protruding portion 22 of cutting face 14. Protruding portion 22 may be located on a central portion 24 of cutting face 14 as shown, for example, in FIG. 1. Protruding portion 22 and raised chip-breaking edge 20 may also be located proximate the periphery 26 of the cutting face 14 as shown, for example, in FIG. 4.

Peripheral sidewall flank 16 together with cutting face 14 and base 18 defines the shape of cutter 10. Suitable shapes for sidewall 16 and cutter 10 include various lozenge shapes that are generally rectangular with opposed semicircular ends (e.g., FIG. 4) and rounded rectangular shapes (e.g., FIGS. 6 and 7) wherein the corners of rectangle are defined by various radii or other curvilinear shapes, and arcuate rectangles (e.g., FIG. 5) wherein the end includes an outwardly convex or inwardly concave curved shape, such as an arc segment, or a combination thereof. Further, peripheral sidewall flank 16 may be planar and extend vertically between and perpendicular to cutting face 14 and base 18, such as where base 18 are the same shape and size (e.g., FIG. 4). Alternately, peripheral sidewall flank 16 may be planar and taper inwardly between cutting face 14 and base 18, such as where base 18 are the same shape, but where cutting face 14 is larger than base 18 (e.g., FIG. 12). Cutting face 14 and base 18 are substantially parallel to one another. By substantially parallel, it is meant that at least a portion of cutting face 14 is parallel to at least a portion of base 18, even though, for example, in some embodiments (not shown) raised chip breaking edge 20 of cutting face 14 may not be parallel to base 18.

Base 18 is configured for bonding cutter 10 to a bonding surface 11 of a cutting tool 13. Base includes a raised portion 19, or a plurality of raised portions 19 and a recessed portion 21, or a plurality of recessed portions 21. More particularly, raised portion 19 may form a planar surface that is configured for mating engagement and touching contact with a planar bonding surface of a cutting face of a downhole cutting tool, as described herein. Where a plurality of raised portions 19 are used, the raised portions 19 may each have a planar surface and the planar surface may include a single plane, such that these planar surfaces are configured for mating engagement and touching contact with a planar bonding surface of a cutting face of a downhole cutting tool, as described herein. The recessed portions include a recessed channel 50 or a plurality of recessed channels, as described herein.

Figure 4:
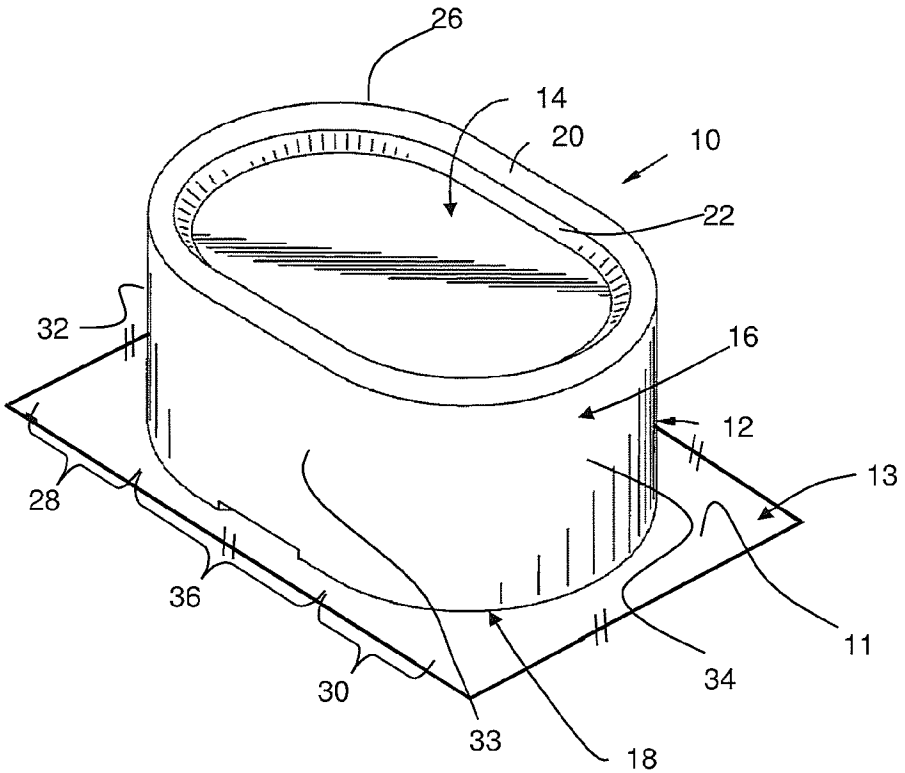
FIG. 4 is a perspective view of a second exemplary embodiment of a cutter as disclosed herein.

Referring to FIGS. 4, 6, 7 and 10-12, the cutter body 12 of the cutter 10 is generally made up of three sections: two opposed end sections 28, 30 with end walls 32, 34 have rounded corners forming the ends of a rounded rectangular shape, or, alternately, are semi-circular in shape as shown, for example, in FIG. 4, and a generally rectangular central section 36 that interconnects the two end sections 28, 30 to result in a rounded rectangular (e.g., FIGS. 6, 7) or "lozenge" shape (e.g., FIG. 4) for cutter 10.

FIGS. 1-13 also illustrate the currently preferred dimensional proportions for the cutter 10. The cutter 10 has an overall axial length 38, as measured from the tip of one end section 28 to the tip of the other end section 30. The cutter 10 also has a width 40 that extends from one lateral side 33 of the central section 36 to the other lateral side 33. The length 38 is greater than the width 40. In the case of cutter 10 having a lozenge shape, the width 40 is also equal to the diameter of the semi-circular end sections 28, 30. In one particular embodiment, the length 38 of cutter 10 is about 1.4 to about 1.6 times the width, and more particularly about 1.5 times the width. In one particular embodiment, the width 40 of cutter 10 is about 1.4 to about 1.6 times the height 42, and more particularly about 1.5 times the height. In one exemplary embodiment, the length is about 0.56 in., the width is about 0.4 in. and the height is about 0.25 in.

Cutter body 12 also includes a recessed channel 50 in base 18 that extends inwardly from peripheral sidewall flank 16 and provides an inlet opening 52 therein. Through-channel configurations also include an outlet opening 53. Cutter body 12 may also include a plurality of recessed channels 50 with a corresponding plurality of inlet openings 52 therein. Many configurations of recessed channel 50 are possible as illustrated in various exemplary embodiments shown in FIGS. 1-13. Regardless of whether a closed-channel or through-channel configuration is used, and whether recessed channel 50 is laterally-extending, longitudinally-extending or diagonally-extending, or a combination thereof, the features associated with the channel, including the length, width or height, and the variations thereof, described herein are applicable to any of these channel configurations. In all of the various configurations of recessed channel 50, the channel has a length (L), a width (W) and a height (H). Each of these dimensional features of recessed channel 50 may be constant, or may vary as a function of one or more of the other features, e.g., the height and width may vary as a function of the length, the length and height may vary across the width and the like. In one embodiment, the width of the channel is at least three times the height. This is illustrated in various exemplary embodiments in FIGS. 1-15 and 19A-C. As also illustrated in these figures, the base 58 of the channel 50 may be planar (e.g., FIGS. 6-13), or may be any suitable non-planar shape including the lenticular profile illustrated in FIGS. 14 and 15 and comprising a plurality of adjacent semicircular grooves, the arch-shaped profile of FIGS. 1-3 and the like. Recessed channel 50 also includes a pair of opposed sidewalls 60 extending from base 58 to raised portion 19 of contact surface 18. The sidewalls 60 may extend vertically (e.g., FIG. 19A), or may taper from base 58 outwardly away from a centerline (or central plane) of recessed channel 50 in a linear (FIG. 19B) or curvilinear (not shown) profile or a combination thereof (not shown), or may comprise one or more outwardly extending steps, wherein the height within the step ($H_1$) or steps is less than the height in the portion of the channel outside the steps (e.g., FIG. 19C). In one exemplary embodiment, the base 58 is curved in the form of an arch, such that effectively there are no sidewalls, or the height of the sidewalls is zero. Further, the height of any of the sidewall 60 profiles described may be varied along the length of recessed channel 50 in the same way that the overall height of the channels may be varied, as described herein. The narrowing of recessed channel 50 at the sidewalls 60 across the width in the manner described, as well as variation in height along the length, may be also be used separately or in combination to enhance capillarity and improve the flow of molten braze material both along the length of recessed channel 50 and across its width. For example, progressive height reduction along the length of the channel will improve the capillarity and flow of molten braze through the channel, and the enhanced flow may also result in improved outward flow along the length of the channel across the surface of the raised portion 19 of base 18, thereby reducing the propensity for entrapment of contaminants and formation of voids. In another example, the narrowing of the sidewalls 60 along the length, or the incorporation of narrowing sidewall 60 features, such as tapers, steps, curved bases will also improve the capillarity and flow of molten braze through the channel, and the enhanced flow may also result in improved outward flow along the length of the channel across the width and surface of the raised portion 19 of base 18, with the benefits noted above. In general, the width of the channel is an important aspect as the braze materials tend to initially favor flow along the periphery of the base 18, as well as the sidewalls of recessed channel 50. Thus, in one embodiment a width that promotes braze flow along both sidewalls through at least a portion of the channel prior to significant interaction of the respective flow streams within the channel is preferred. In another embodiment, the width is at least one third of the length of the channel. In the various embodiments, capillarity or capillary driving pressure of the molten braze material within recessed channel 50 is directly proportional to the wetting, as measured by the wetting angle, divided by the area of the channel.

In the exemplary embodiment of FIGS. 1-3, the height varies across the width of channel 50 in the form of an arch. The arch may be defined as a function defining a radius of curvature but various other curvilinear functions and forms are possible. In this configuration the height varies from about 0 at the peripheral edge 54 of the channel to an apex 56 identified by section line 2-2. As illustrated in FIG. 2, the height also varies as a function of and along the length. As illustrated in FIG. 3, the width of recessed channel 50 also varies as a function of and along the length. In this case, the variation in both height and width are linear variations; however, curvilinear variations and other functional relationships are also possible. The variation in both height and width along the length, as well as the variation of the height across the width can contribute to improve capillarity of a molten braze material within recessed channel 50 when base 18 is placed in touching contact with a bonding surface of a cutting tool. The width and height at one end and the variation of the width and height along the length, as well as the variation in height across the width, may be selected to provide the desired capillarity, which may vary along the length of recessed channel 50, and which is improved within recessed channel 50 over the touching contact arrangement that exists between the base 18 of the cutter body and the bonding surface 11 of the cutting tool around the periphery of the cutter body 12 outside of the channel and within the raised portions 19, i.e., the arrangement that would exist but for the presence of the channel. Capillary driving pressure is proportional the channel perimeter divided by its cross sectional area. Flow resisting pressure decreases with increasing cross sectional area. So as the channel cross section is made greater, the resistance to flow is decreased, but the capillary suction pressure is also decreased. The arch of the channel is to make it just tall enough to reduce flow resistance without too much reduction in capillary driving pressure. Also, the greater the length of the channel, the greater the resistance to flow. This variation in capillarity enhances the flow of the molten braze within the channel, but it also enhances the flow across the raised portion 19 of base 18 that is outside of recessed channel 50, i.e., the portion of base 18 that is in touching contact with the bonding surface of the cutting tool prior to brazing. The enhanced flow promotes wetting of these portions of base 18, thereby lowering the propensity for entrapment of fluxes, air or other contaminants in these portions of base 18. The amount of brazing material fed during brazing of cutter 10 to cutting tool 13 will preferably be sufficient to wet and cover the raised portion 19 and, upon cooling and resolidification of the braze material form a braze joint therebetween, as well as completely filling the recessed portion 21 and recessed channel 50, thereby forming a continuous metallurgical bond between cutting face 18 and the portion of bonding surface 11 of cutting tool 13, as illustrated in FIG. 19.

Figure 5:
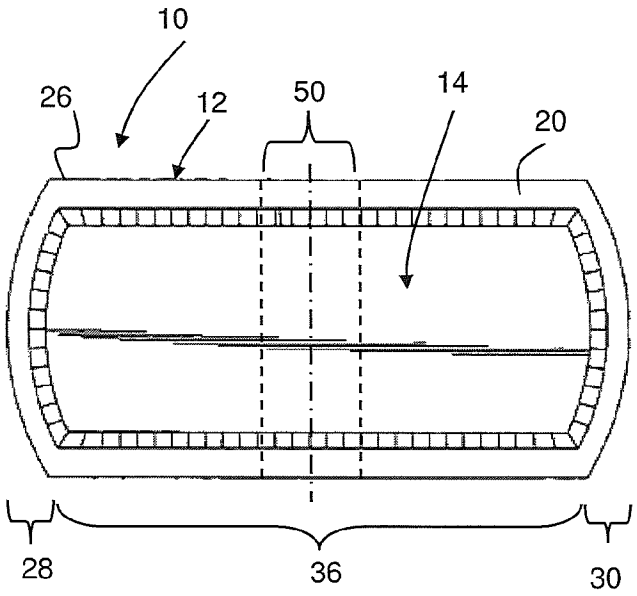
FIG. 5 is a top view of a third exemplary embodiment of a cutter as disclosed herein.

In the exemplary embodiments of FIGS. 4 and 5, the height is constant across the width of channel 50, and when placed in touching contact with a planar bonding surface 11 of the cutting tool 13 forms an enclosed channel having a substantially rectangular channel profile. By substantially rectangular, it is meant that the adjacent channel walls are generally orthogonal, and the opposing channel walls are generally parallel; however, the corners and edges that define the channel may rounded or tapered to improve wettability, manufacturing, and other considerations. As illustrated in FIGS. 4 and 5, the height and width are also constant along the length. In this embodiment, the height and width may be selected to provide the desired capillarity, which may be essentially constant within the recessed channel 50 and the improvements described herein. Any suitable height and width of recessed channel may be employed to promote enhanced capillarity. In an exemplary embodiment, the height of the recessed channel may be selected from a range of about 0.003 in. to about 0.020 in. The area of the recessed channel may include about 25% to about 75% of the area of the base.

Figure 6:
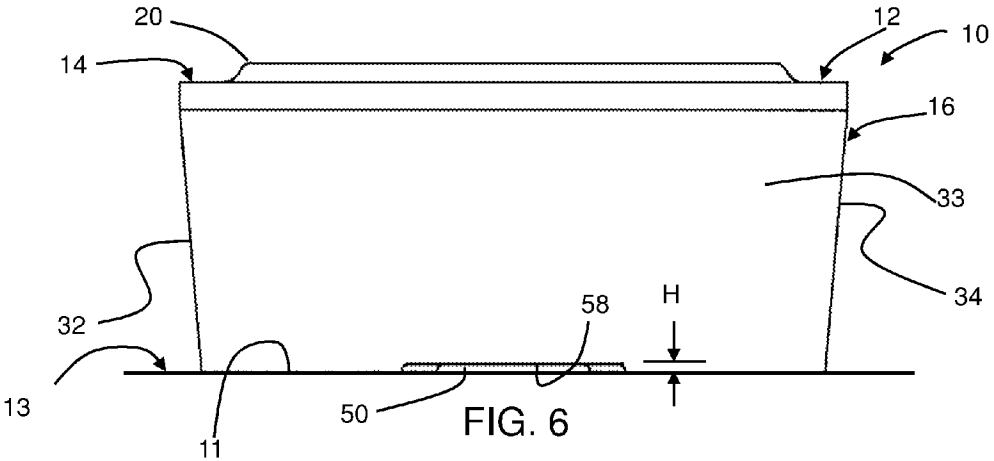
FIG. 6 is a front view of a third exemplary embodiment of a cutter as disclosed herein.
Figure 7:
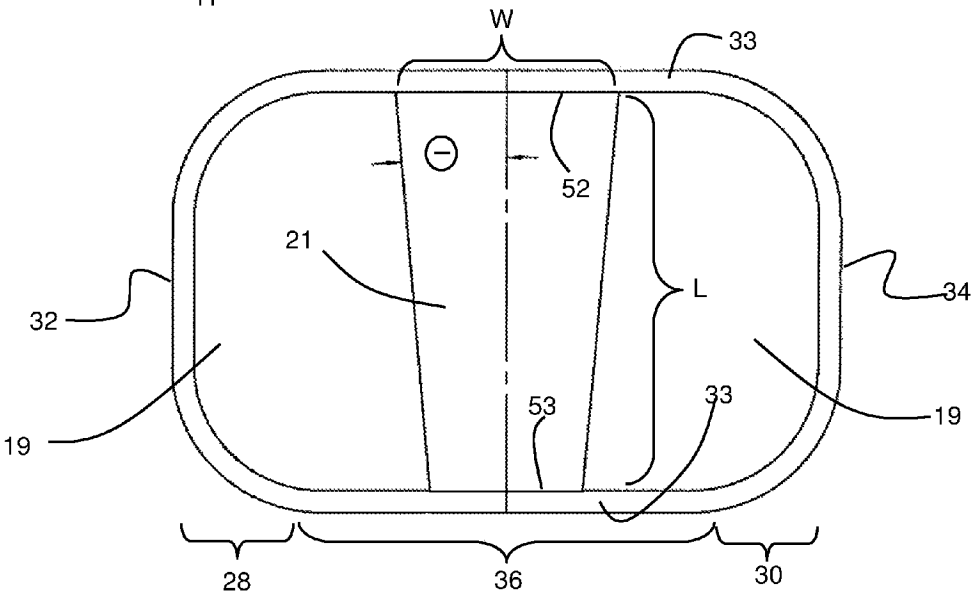
FIG. 7 is a bottom view of the cutter of FIG. 6.

In the exemplary embodiment of FIGS. 6 and 7, the height is constant and the width varies along the length of channel 50, the width and height forming an enclosed substantially rectangular channel profile that varies in width along the length when placed in touching contact with a planar bonding surface 11 of the cutting tool 13. In this case, the variation in width is a linear variation; however, curvilinear variations and other functional relationships varying the width are also possible. The variation in width along the length can contribute to improve capillarity of a molten braze material within recessed channel 50 when base 18 is placed in touching contact with a bonding surface of a cutting tool. In this embodiment, the width at one end and the variation of the width along the length may be selected to provide the desired capillarity, which may vary along the length of recessed channel 50, and the improvements described herein.

Figure 9:
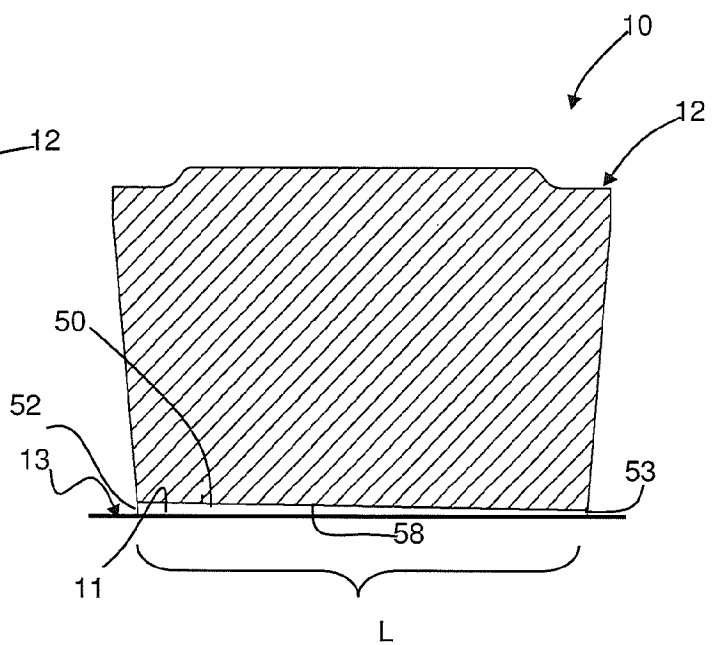
FIG. 9 is a cross-sectional view of the cutter of FIG. 8 taken along section 8-8 thereof.
Figure 8:
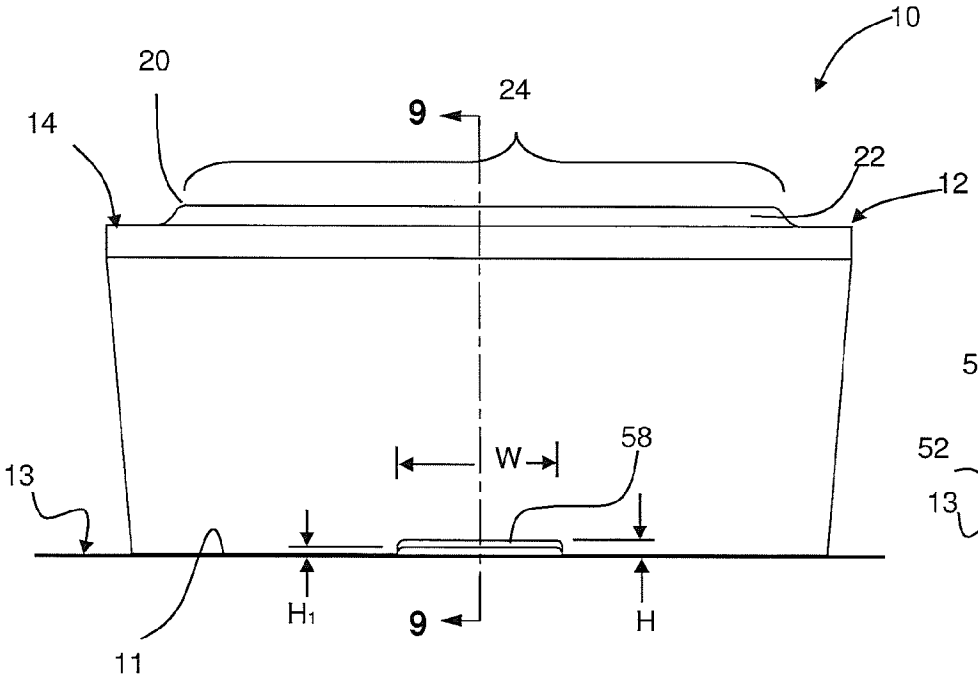
FIG. 8 is a front view of a fourth exemplary embodiment of a cutter as disclosed herein.
Figure 11:
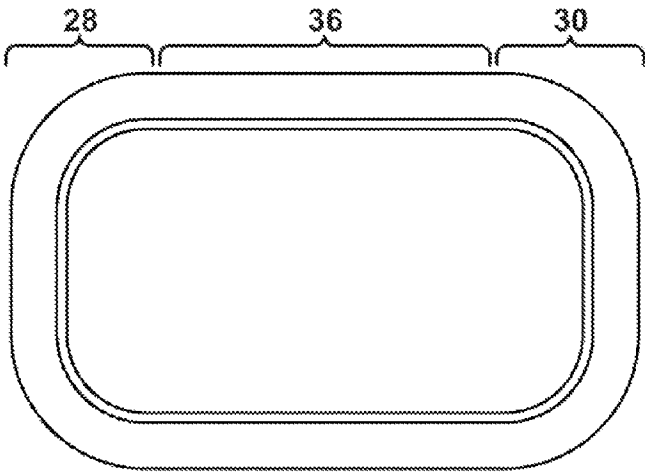
FIG. 11 is a top view of the cutter of FIG. 10.
Figure 13:
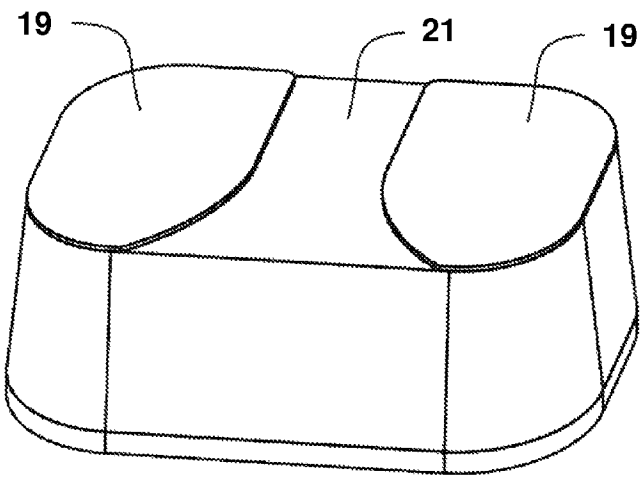
FIG. 13 is a perspective view of the bottom of the cutter of FIG. 10.
Figure 10:
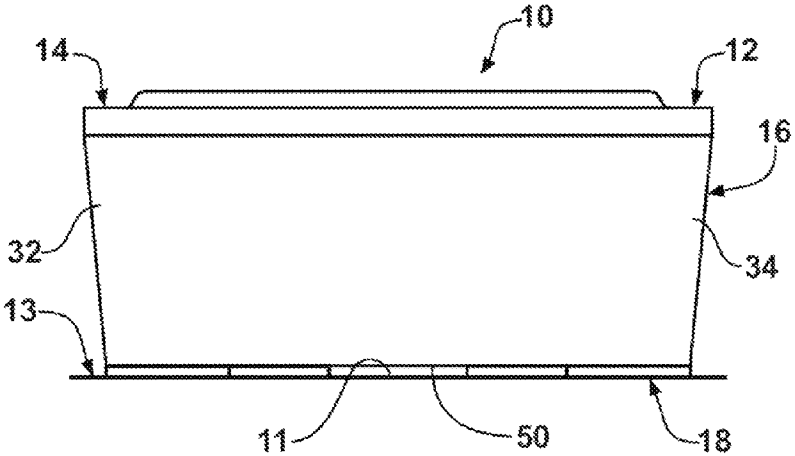
FIG. 10 is a front view of a fifth exemplary embodiment of a cutter as disclosed herein.
Figure 12:
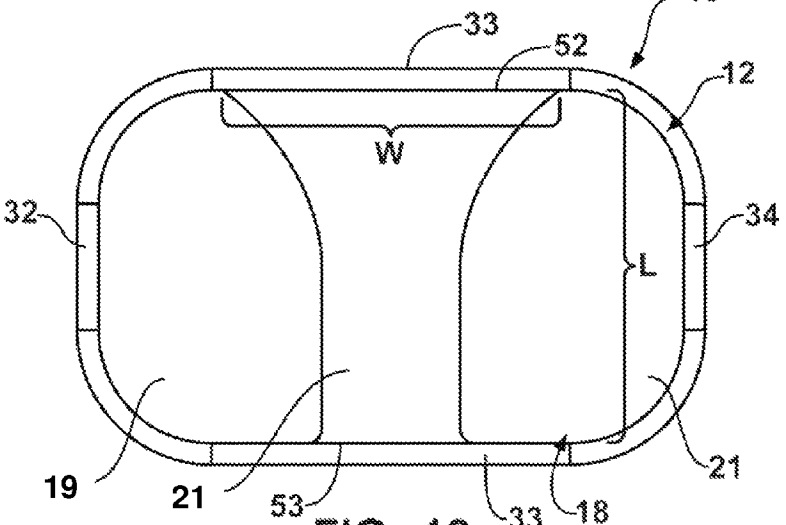
FIG. 12 is a bottom view of the cutter of FIG. 10.

In the exemplary embodiment of FIGS. 8 and 9, the width is constant and the height varies along the length of channel 50, the width and height forming an enclosed rectangular channel profile that varies in height along the length when placed in touching contact with a planar bonding surface 11 of the cutting tool 13. In this case, the variation in height is a linear variation; however, curvilinear variations and other functional relationships varying the height are also possible. The variation in height along the length can contribute to improve capillarity of a molten braze material within recessed channel 50 when base 18 is placed in touching contact with a bonding surface of a cutting tool. In this embodiment, the height at one end and the variation of the height along the length may be selected to provide the desired capillarity, which may vary along the length of recessed channel 50, and the improvements described herein.

In the exemplary embodiment of FIGS. 10-13, the height is constant and the width varies along the length of channel 50, the width and height forming a substantially rectangular channel profile that varies in width along the length, similar to the embodiment of FIGS. 6 and 7, and when placed in touching contact with a planar bonding surface 11 of the cutting tool forms an enclosed channel having a substantially rectangular channel profile. In this case; however, the variation in width is a non-linear variation. The width varies by converging inwardly from one lateral side in accordance with a first radius of curvature and then is constant along a portion of the length, and then varies further by diverging in accordance with a second radius of curvature. The variation in width along the length can contribute to improve capillarity of a molten braze material within recessed channel 50 when base 18 is placed in touching contact with a bonding surface of a cutting tool. In this embodiment, the width at one end and the variation of the width along the length may be selected to provide the desired capillarity, which may vary along the length of recessed channel 50, and the improvements described herein.

Figure 14:
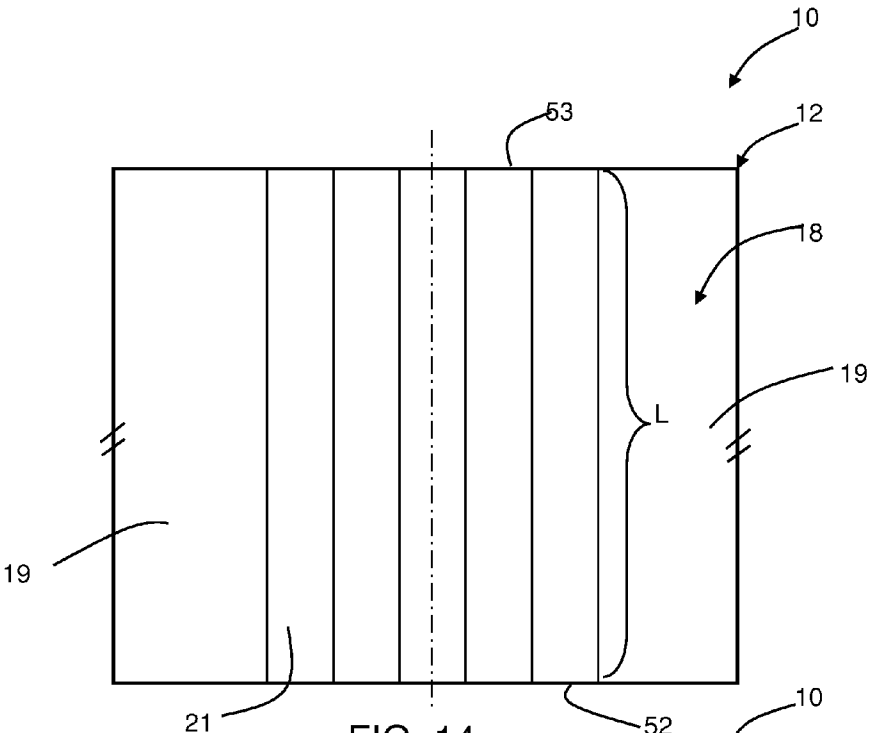
FIG. 14 is an exemplary embodiment of a cutter channel as disclosed herein.
Figure 15:
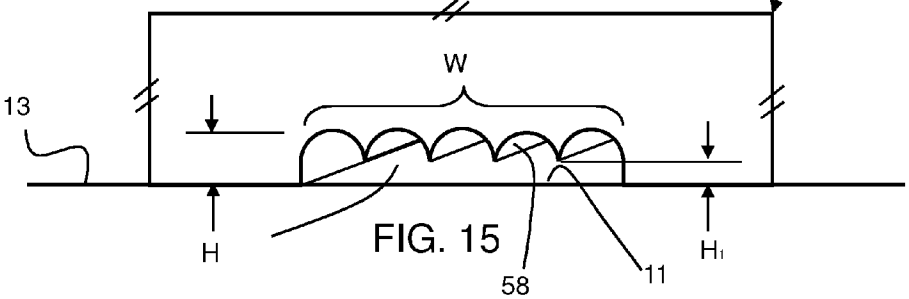
FIG. 15 is a front partial perspective view of the cutter channel of FIG. 14.

In the exemplary embodiment of FIGS. 14 and 15, the width is constant and the height varies across the width of channel 50 according to a lenticular pattern formed in the base 58, the width and variable height forming an enclosed partially rectangular channel profile that varies in height across the width and does not vary along the length when placed in touching contact with a planar bonding surface 11 of the cutting tool 13. In this case, the variation in height is a curvilinear variation. The variation in height across the width can contribute to improve capillarity of a molten braze material within recessed channel 50 when base 18 is placed in touching contact with a bonding surface of a cutting tool. In this embodiment, the curvilinear profile and the variation of the height across the width may be selected to provide the desired capillarity, which may vary across the width and thereby also along the length of recessed channel 50, and the improvements described herein.

Figure 19A:
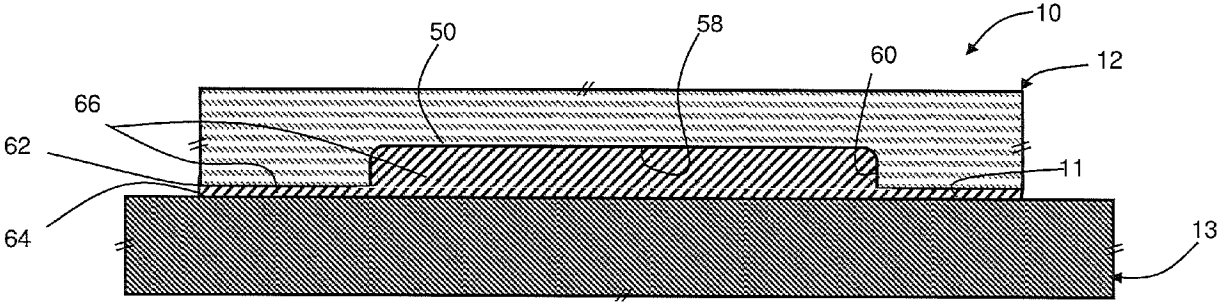
FIGS. 19A-19C are cross-sectional illustrations of a plurality of metallurgical bond and braze joint as disclosed herein.
Figure 19B:
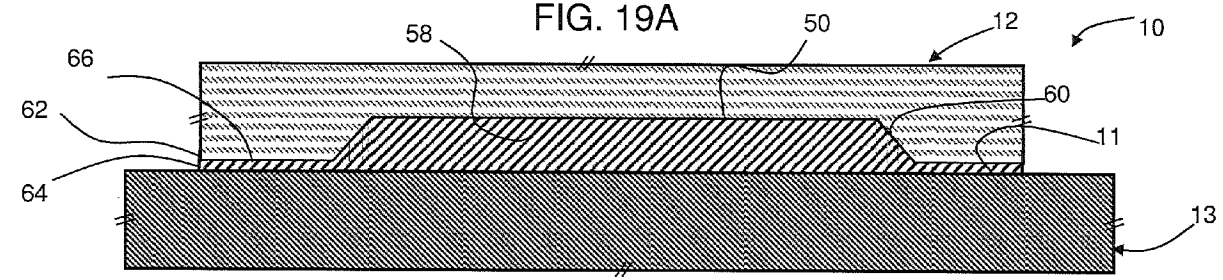
Figure 19C:
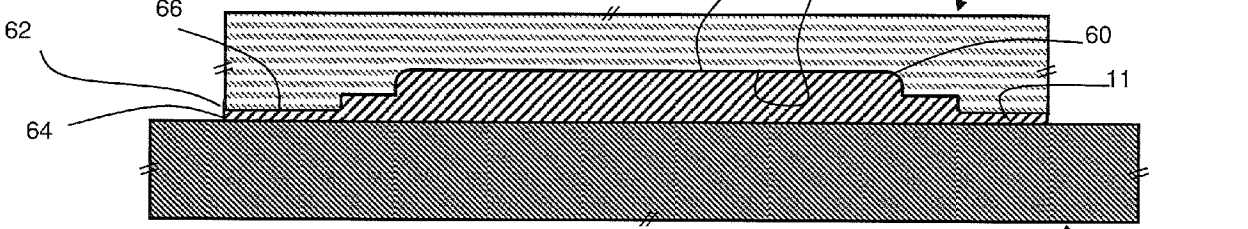

Referring to FIGS. 19A-19C, cutter 10 may be joined to a bonding surface 11 of cutting tool 13, wherein a molten braze material is introduced to the inlet opening 52 of recessed channel 50, and wherein a molten braze material is caused to flow within recessed channel 50. The flow of the molten braze material within recessed channel 50 is influenced by the capillarity thereof including the various features described herein to enhance the capillarity and improve flow of the molten braze material within the channel. Preferably, sufficient molten braze material is supplied to completely fill recessed channel 50 as well as the space between raised portions 19 of base 18 and bonding surface 11 of cutting tool 13. The molten braze material interacts with the material of cutter 10 at base 18 forming a metallurgical bond 62 therewith upon resolidification of the braze material. The braze material also interacts with the material at bonding surface 11 of cutting tool 13 forming a metallurgical bond 64 therewith upon resolidification of the molten braze material. Metallurgical bonds 62 and 64 together with the solidified braze material form a braze joint 66 between cutter 10 and cutting tool 13.

While braze joint 66 has a lower strength, particularly sheer strength associated with the increased thickness associated of the joint within recessed channel 50, this decrease is generally insignificant in comparison with the improved strength associated with a reduction of voids within the portion of braze joint associated with raised portion 19 of base 18 due to the improved flow characteristics outside of recessed channel 50 as described herein, particularly if the joint is void-free.

Figure 16:
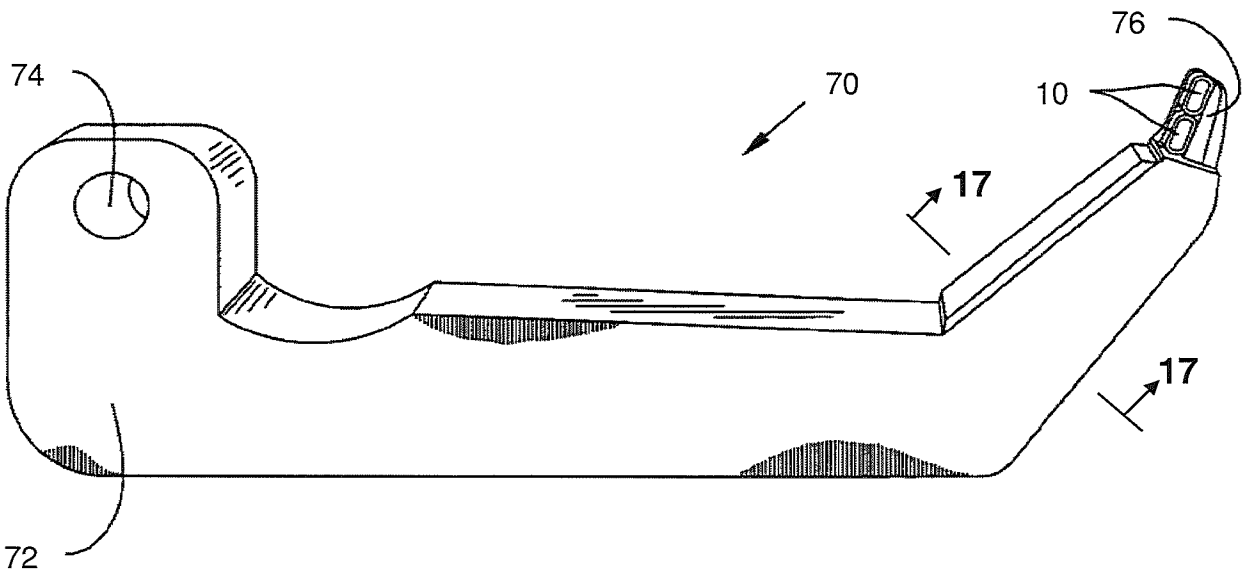
FIG. 16 is a perspective view of an arm of a mandrel cutter as disclosed herein.
Figure 17:
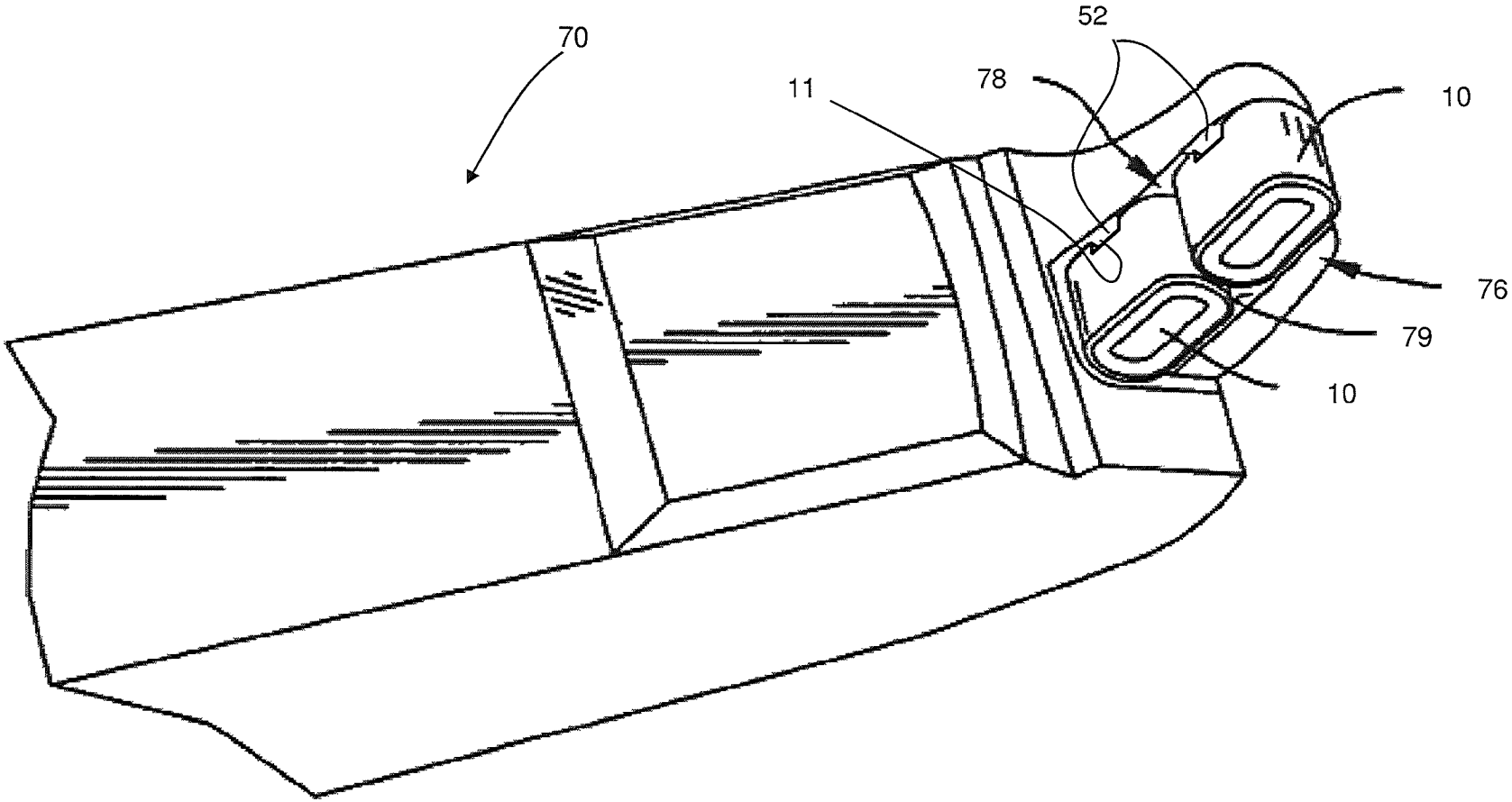
FIG. 17 is an enlarged perspective view of section 16-16 of the arm of FIG. 16.

FIGS. 16 and 17 depict an exemplary arm 70 for a mandrel cutting tool 13. The arm 70 includes a proximal portion 72 having a pin opening 74 into which the arm 70 is pivotally attached to a cutting tool mandrel (not shown) and a distal cutting portion 76. The distal cutting portion 76, which is more clearly depicted in the close up view of FIG. 17, includes a cutter retaining area 78 and bonding surface 11 that is bounded by side surface 77 and shelf 79. Cutters 10 are accommodated inside the cutter retaining area 78 and leave very little interstitial space. Arm 70 and cutters 10 are illustrated in FIGS. 16 and 17 prior to forming the braze joint.

Figure 18:
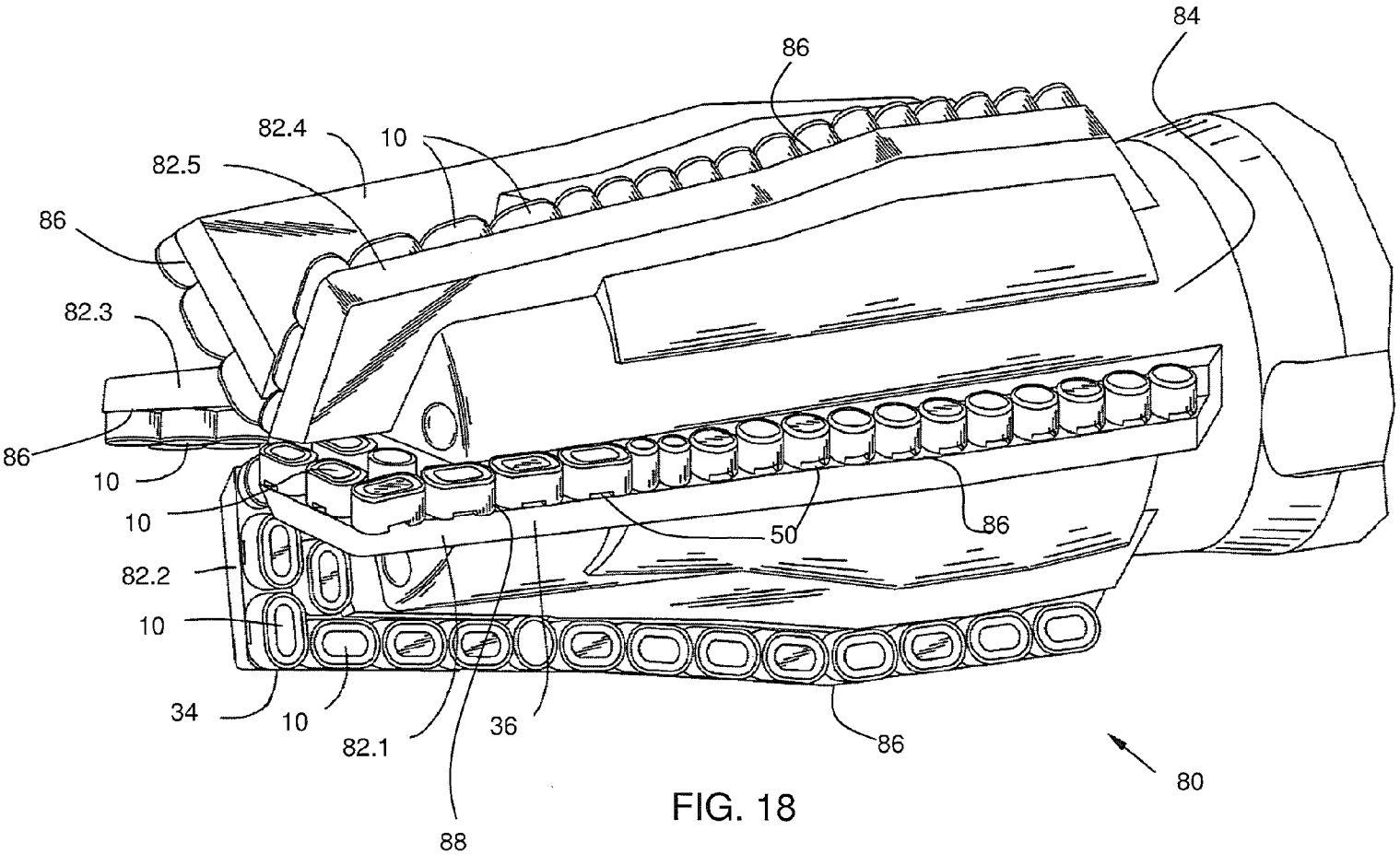
FIG. 18 is a perspective view of an exemplary embodiment of a rotary cutting mill as disclosed herein.

FIG. 18 illustrates an exemplary cutting tool 13 that includes a rotary cutting mill 80 of the type used in sidetracking operations to mill a lateral opening in wellbore casing. Cutting mills of this design are generally known in the art, and include the SILVERBACK™ window mill available commercially from Baker Oil Tools of Houston, Tex. The cutting mill 80 has five cutting blades, or arms, 82 that are rotated about hub 84 during operation. Each of these blades 82.1-82.5 has cutters 10 mounted on bonding surfaces 11 of cutter faces 86. It is noted that the blades 82 may include some rounded cutters 10 that include recessed channels 50, as well as lozenge-shaped cutters 10 that include recessed channels 50. It is further noted that the cutters 10 are mounted upon the cutting blades 82.1-82.5 in a manner such that the cutters 10 are offset from one another in adjacent blades. For example, the distal tip of the edge of blade 82.1 has four cutters 10 that are arranged in an end-to-end manner. However, the neighboring blade 82.2 has the lead cutter 10 turned at a 90 degree angle to the other cutters 10, thereby causing the interstitial space 88 between the cutters 10 on adjacent blades to be staggered along the length on adjacent blades 82. As a result of this staggering, the blades 82.1-82.5 will become less worn in the interstitial spaces 88.

Cutting tool 13 and bonding surface 11 may be formed from any suitable tool material having the requisite tensile strength, fracture toughness and other mechanical properties. In an exemplary embodiment, suitable tool materials include various steels, including stainless steels, as well as Ni-base alloy and Co-base alloys.

Any braze materials suitable for bonding to bonding surface 11 of cutting tool 13 may be used to make a braze joint 66 as described herein. Depending on the specific material selected for bonding surface 11, suitable braze materials include various nickel bronze alloys, silver solder alloys, soft solders and NiCrB alloys While one or more embodiments have been shown and described, modifications and substitutions may be made thereto without departing from the spirit and scope of the invention. Accordingly, it is to be understood that the present invention has been described by way of illustrations and not limitation.

We claim:

1. A cutter comprising a cutter body having a cutting face, a peripheral sidewall flank, and a base, the base comprising a planar raised portion and a recessed channel that extends inwardly from an inlet opening in the peripheral sidewall flank continuously to an outlet opening therein, the recessed channel having a height, a width and a length and comprising a pair of opposed sidewalls extending from a base surface of the recessed channel to the planar raised portion, wherein one of the width or height varies along the length of the recessed channel, the base configured for brazing to a planar substrate bonding surface that does not intrude into the recessed channel.

2. The cutter of claim 1, wherein both the width and height vary along the length of the recessed channel.

3. The cutter of claim 1, wherein the height varies across the width of the recessed channel.

4. The cutter of claim 1, wherein the width varies along the length of the recessed channel.

5. The cutter of claim 1, wherein the height varies along the length of the recessed channel.

6. The cutter of claim 1, wherein the width is at least three times the height.

7. The cutter of claim 1, wherein the recessed channel has a longitudinal axis and the base surface of the channel has a longitudinally extending raised portion.

8. The cutter of claim 7, wherein the longitudinally extending raised portion has a height, and wherein the height of the raised portion is less than the height of the recessed channel.

9. The cutter of claim 7, wherein the longitudinally extending raised portion comprises a plurality of adjoining portions of a plurality of adjoining longitudinally extending grooves having a lenticular pattern.

10. The cutter of claim 1, wherein the recessed channel comprises a plurality of recessed channels, each extending inwardly from an inlet opening in the peripheral sidewall flank to an outlet opening therein.

11. The cutter of claim 1, wherein the cutting face has a protruding portion.

12. The cutter of claim 11, wherein the protruding portion is located on a periphery of the cutting face or a central portion of the cutting face, or a combination thereof.

13. The cutter of claim 1, wherein the base is substantially parallel to the cutting face.

14. The cutter of claim 1, wherein the periphery of the sidewall has an elliptical, rounded rectangle or circular shape.

15. A downhole cutting tool, comprising:

a cutting tool having a planar substrate bonding surface, the cutting tool formed from steel, a Ni-base alloy or a Co-base alloy;

a cutter body having a cutting face, a peripheral sidewall flank, and a base, the base comprising a planar raised portion and a recessed channel that extends inwardly from an inlet opening in the peripheral sidewall flank continuously to an outlet opening therein, the recessed channel having a height, a width and a length and comprising a pair of opposed sidewalls extending from a base surface of the recessed channel to the planar raised portion, wherein one of the width or height varies along the length of the recessed channel, the cutter body formed from tungsten carbide; and a braze joint comprising a braze material between the base and the planar substrate bonding surface, the braze joint disposed in the recessed channel and defined by the planar substrate bonding surface, wherein the planar substrate bonding surface does not intrude into the recessed channel.

16. The downhole cutting tool of claim 15, wherein both the width and height vary along the length of the recessed channel.

17. The downhole cutting tool of claim 15, wherein the height varies across the width of the recessed channel.

18. The downhole cutting tool of claim 15, wherein the width varies along the length of the recessed channel.

19. The downhole cutting tool of claim 15, wherein the height varies along the length of the recessed channel.

20. The downhole cutting tool of claim 15, wherein the width is at least three times the height.

21. The downhole cutting tool of claim 15, wherein the recessed channel has a longitudinal axis and the base surface of the recessed channel has a longitudinally extending raised portion.

22. The downhole cutting tool of claim 15, wherein the braze material comprises a nickel bronze alloy, a solder alloy or a NiCrB alloy.

23. A cutter for a downhole cutting tool, comprising:

a cutter body comprising tungsten carbide having a cutting face, a peripheral sidewall flank, and a base, the base comprising a planar raised portion and a recessed channel that extends inwardly from an inlet opening in the peripheral sidewall flank continuously to an outlet opening therein, the recessed channel having a height, a width and a length and comprising a pair of opposed sidewalls, wherein one of the width or height varies along the length of the recessed channel, the base configured for brazing to a planar substrate bonding surface that does not intrude into the recessed channel; and a braze joint comprising a braze material, the braze joint disposed in recessed channel and defined by the planar substrate bonding surface.

24. A cutter comprising a tungsten carbide cutter body having a cutting face, a peripheral sidewall flank, and a base, the base comprising a planar raised portion and a recessed braze channel that extends inwardly from an inlet opening in the peripheral sidewall flank continuously to an outlet opening therein, the recessed braze channel having a height, a width and a length and comprising a pair of opposed sidewalls extending from a base surface of the recessed braze channel to the planar raised portion, at least one of the width or height varies along the length of the recessed braze channel, the base configured for brazing to a planar substrate bonding surface that does not intrude into the recessed channel.

25. A method of making a downhole cutting tool, comprising:

providing a cutting tool having a planar substrate bonding surface, the cutting tool formed from steel, a Ni-base alloy or a Co-base alloy;

providing a cutter body comprising tungsten carbide and having a cutting face, a peripheral sidewall flank, and a base, the base comprising a planar raised portion and a recessed channel that extends inwardly from an inlet opening in the peripheral sidewall flank continuously to an outlet opening therein, the recessed channel having a height, a width and a length and comprising a pair of opposed sidewalls extending from a base surface of the recessed channel to the planar raised portion, wherein one of the width or height varies along the length of the recessed channel, the base configured for brazing to the planar substrate bonding surface;

placing the base of the cutter body in contact with the planar substrate bonding surface, wherein the planar substrate bonding surface does not intrude into the recessed channel;

providing a molten braze material proximate the recessed channel, the recessed channel providing variable capillarity and flow of the molten braze material between the recessed channel and the planar substrate bonding surface; and cooling and solidifying the molten braze material to form a braze joint disposed in the recessed channel and defined by the planar substrate bonding surface of the cutting tool.

26. A method of using a downhole cutting tool, comprising:

providing a downhole cutting tool, comprising:

a cutting tool having a planar substrate bonding surface, the cutting tool formed from steel, a Ni-base alloy or a Co-base alloy;

a cutter body comprising tungsten carbide having a cutting face, a peripheral sidewall flank, and a base, the base comprising a planar raised portion and a recessed channel that extends inwardly from an inlet opening in the peripheral sidewall flank continuously to an outlet opening therein, the recessed channel having a height, a width and a length and comprising a pair of opposed sidewalls extending from a base surface of the recessed channel to the planar raised portion, wherein one of the width or height varies along the length of the recessed channel; and a braze joint comprising a braze material between the base and the planar substrate bonding surface, the braze joint disposed in the recessed channel and defined by the planar substrate bonding surface, wherein the planar substrate bonding surface does not intrude into the recessed channel; and using the downhole cutting tool to perform a downhole cutting operation.

* * * * *